US006077651A

United States Patent [19]

Darmon et al.

[11] Patent Number: 6,077,651

[45] Date of Patent: Jun. 20, 2000

[54] HOMOGENEOUS SINGLE-PART PHOTOGRAPHIC COLOR DEVELOPING CONCENTRATE AND METHOD OF MAKING

[75] Inventors: Charles M. Darmon, Spencerport; Jean M. Buongiorne, Brockport; Michael J. Haight, Rochester; Paul A. Schwartz, Webster, all of N.Y.

[73] Assignee: Eastman Kodak Company, Rochester, N.Y.

[21] Appl. No.: 09/132,200

[22] Filed: Aug. 11, 1998

[51] Int. Cl.[7] ..... G03C 7/413

[52] U.S. Cl. ..... 430/466; 430/434; 430/450; 430/497

[58] Field of Search ..... 430/466

[56] References Cited

U.S. PATENT DOCUMENTS

| | | | |
|---|---|---|---|
| 3,574,619 | 4/1971 | Surash | 430/466 |
| 5,273,865 | 12/1993 | Loiacono et al. | 430/490 |
| 5,660,974 | 8/1997 | Marrese et al. | 430/490 |
| 5,837,435 | 11/1998 | Abe | 430/490 |

FOREIGN PATENT DOCUMENTS

| | | |
|---|---|---|
| 0 204 372 A1 | 12/1986 | European Pat. Off. . |
| 0 793 141 A2 | 9/1997 | European Pat. Off. . |
| 0 800 111 A1 | 10/1997 | European Pat. Off. . |

*Primary Examiner*—Hoa Van Le
*Attorney, Agent, or Firm*—J. Lanny Tucker

[57] ABSTRACT

An aqueous, homogeneous, single-part color developing concentrate comprises a color developing agent in free base form, an antioxidant for the color developing agent, a buffering agent, and a water-miscible or water-soluble hydroxy-substituted, straight-chain organic solvent present in an a concentration such that the weight ratio of water to the organic solvent is from about 15:85 to about 50:50. This composition is prepared in a unique manner, namely by combining the noted components, and removing the sulfate anions commonly present in color developing agents by precipitation with alkali metal ions, before addition of further components. The concentrate can be used to make a working strength processing solution, or it can be used as a replenishing composition with proper dilution.

21 Claims, No Drawings

HOMOGENEOUS SINGLE-PART PHOTOGRAPHIC COLOR DEVELOPING CONCENTRATE AND METHOD OF MAKING

FIELD OF THE INVENTION

The present invention relates to single-part, homogeneous photographic color developing concentrates and to a method for their manufacture. These concentrates and methods are useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al) describes conventional color developing compositions that have found considerable commercial success in the photographic industry. Other known color developing compositions are described in U.S. Pat. No. 4,876,174 (Ishikawa et al), U.S. Pat. No. 5,354,646 (Kobayashi et al) and U.S. Pat. No. 5,660,974 (Marrese et al).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and water, a homogeneous color developing composition can usually be obtained for the working strength solution in the processing machine.

There is a desire in the industry to reduce the number of parts used to prepare color developing compositions, and particularly to prepare replenishing solutions. A wide range of compositions are described in the art or commercially available as "ready to use" solutions, concentrates or dry formulations. Liquid concentrates have only to be diluted with water to provide a working strength solution. Dry formulations need only be dissolved in water. For example, EP-A-0 793,141 (Chugai Photo) describes a two-part color developing composition that can be supplied in either solid or liquid form.

It is generally known that the concentrations of various photochemicals used in a photographic processing bath must lie within certain narrow limits in order to provide optimal performance. The most important solvent for such photoprocessing is water. Most inorganic salts can be readily dissolved in water while the organic photochemicals in such processing baths usually have suitable solubility in water at the desired operating concentrations.

However, water is both an asset and a major problem of ready-to-use and some concentrated photographic compositions because of its presence in high quantity. As a result, the costs of manufacturing, transport and storage of such compositions is steadily growing. Normally, the user of photochemical compositions has water available in which individual photochemicals could be mixed or diluted, but this is usually not practical for a number of reasons. The exact composition of the photochemicals is not readily determined by a common user and manufacturers are not likely to readily provide their formulations for such a purpose. Moreover, even if the formulations are known, mixing mistakes may result in poor photoprocessing results.

For these reasons, there is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

The industry has investigated the use of both concentrates and solid mixtures (including powders and tablets). In most cases, concentrates are convenient to use but may have high packaging costs compared to powders. Powders permit high concentration, but not every photochemical composition can be dried into a stable powder. In addition, powders present problems with dust, separate packaging needs and more troublesome metering or mixing procedures. Not all dry formulations are readily dissolved in water.

Another concentrated form known in the art is a chemical paste or slurry, as described for example in EP-A-0 204,372 (Chemco) and EP-A-0 800,111 (Fuji Photo). These formulations have still other disadvantages, namely lack of homogeneity and slow dissolution rate of solid components.

The casual observer might consider that all of the conventional "parts" used to provide color developing compositions might be readily combined to form a single-part homogeneous composition. This is not as easy as one may think. Interactions among and deterioration of photochemicals are magnified in concentrated form, and the resulting action on processed photographic materials ay be undesirable because of the resulting poor images.

Some color developing compositions are commercially available in single-part formulation that overcomes some of the noted problems, but because of the presence of precipitates (such as in slurries) or multiple solvent phases, they require vigorous agitation or mixing before use. Such compositions are generally limited to small volumes. In addition, the presence of the precipitates or "sludge" may be unattractive to users. Some users may not have suitable equipment for proper agitation of multi-phase compositions.

Additional small volume, ready to use color developing compositions are described in U.S. Pat. No. 5,273,865 (Loiacono et al). These compositions are said to be free of bromides, hydroxylamines and benzyl alcohol, to include a polyol compound having 4 to 8 hydroxy groups, and to be useful for rapid access processing of photographic elements having high silver bromide emulsions only.

There is a continuing need in the photographic industry for a single-part color developing composition that is homogeneous, concentrated and stable. Such compositions would reduce the cost of shipping and storage of diluted solutions, avoid the need for mixing multiple parts or agitation of multi-phase compositions, and offer the user a more attractive product. The present invention is directed to meeting this long felt need.

SUMMARY OF THE INVENTION

This invention provides an advance in the art with a homogeneous, single-part color developing concentrate having a pH of from about 7 to about 13, and comprising:

a) at least 0.06 mol/l of a color developing agent in free base form, b) at least 0.05 mol/l of an antioxidant for the color developing agent, c) water, d) a photographically inactive water-miscible or water-soluble hydroxy-containing, straight-chain organic solvent for the color developing agent in free base form, the organic solvent having a molecular weight of from about 50 to about 200 and being present in the concentrate at a concentration such that the weight ratio of water to the solvent is from about 15:85 to about 50:50, and e) a buffering agent that is miscible in the organic solvent.

This invention also provides a photographic processing chemical kit comprising:

a) the single-part color developing concentrate described above, and b) one or more of the following compositions:
a photographic bleaching composition,
a photographic bleach/fixing composition,
a photographic fixing composition, and
a photographic stabilizing or final rinsing composition.

Further, this invention includes a method for providing an image in a photographic color silver halide element comprising contacting a photographic color silver halide element with, upon dilution at least four times, the single-part color developing concentrate described above. This color developing step in a photographic processing method can be followed by desilvering the developed photographic color silver halide element, as well as any other useful photoprocessing steps known in the art.

Still again, a method of preparing the homogeneous, single-part color developing concentrate described above comprises the steps of:

A) mixing in water, a color developing agent present as a sulfate salt, an antioxidant for the color developing agent, an alkali metal base to provide alkali metal ions in at least stoichiometric proportion to sulfate ions present in the sulfate salt, and a photographically inactive water-miscible or water-soluble, hydroxy-containing, straight-chain organic solvent, the organic solvent having a molecular weight of from about 50 to about 200 and being present in the concentrate at a concentration such that the weight ratio of water to the solvent is from about 15:85 to about 50:50, to form a water-insoluble alkali metal sulfate in the solution, and B) removing the water-insoluble alkali metal sulfate from the solution.

The single-part color developing concentrate and method for its preparation offer a number of advantages over the photochemical compositions currently available or known. Our concentrate has minimal water, resulting in considerable savings in manufacturing, shipping and storage costs. In addition, it is a homogeneous composition, meaning that it is free of precipitates, slurries or multiple solvent phases. It does not require vigorous agitation prior to use, and can be immediately and readily metered into a photographic processing tank or bath with minimal instruction or possibility of mistake. For example, the concentrate can be used in "automatic replenishing" processors where the processing composition is diluted and used as needed. Importantly, it provides a single-part composition so the mixing of multiple parts, whether liquid or solid, is avoided.

The concentrate of this invention, and the resulting working strength color developing composition, have less odor than many conventional multi-part color developing compositions. Moreover, it was unexpected to us that formulating the chemicals needed for color development into a single-part composition resulted in no loss in chemical stability of any of those chemicals (such as the antioxidant and color developing agent) and pH. This was unexpected because it is well known in the art that several of such chemicals adversely affect each other, and because of that, they were usually separated in multiple parts for shipping and storage.

The homogeneity noted above have been achieved because of our discovery that the presence of high sulfate ion concentration is detrimental to composition stability. The sulfate ion is likely to cause precipitation when attempts are made to reduce the water content and to provide all of the desired photochemicals in a single part solution. Thus, once we determined the source of the problem, we discovered a way to remove the sulfate ion with a mixing sequence that is an advance in the art. We removed the sulfate ions during a first step of the formulation procedure, providing a substantially clear solution that is ready to use for making up a working strength solution, or as a replenisher.

The sulfate ions are removed early in the formulation of the composition by precipitating them in the presence of an alkali metal base and a particular water-soluble or water-miscible hydroxy-containing, straight-chain organic solvent. This solvent has a critical molecular weight of from about 50 to about 200 for effectiveness and solubility. The sulfate precipitate is readily removed before additional photochemicals are added to the solution. Preferably, the resulting color developing concentrate is essentially sulfate ion free (meaning less than 0.005 mol/l of sulfate ion).

DETAILED DESCRIPTION OF THE INVENTION

The homogeneous, single-part color developing concentrate of this invention is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation or decantation). If the antioxidant is a liquid organic compound, two phases may be formed and the precipitate may be removed by discarding the aqueous phase.

The color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 09/123,976 (filed Jul. 29, 1998 by Qiao and McGarry), and entitled "Photographic Developing Compositions and Methods of Using 1,4-Cyclohexanediones As Antioxidants". Mixtures of compounds from the same or different classes of antioxidants can also be used if desired.

Especially useful antioxidants are hydroxylamine derivatives as described for example, in U.S. Pat. No. 4,892,804, U.S. Pat. No. 4,876,174, U.S. Pat. No. 5,354,646, and U.S. Pat. No. 5,660,974, all noted above, and U.S. Pat. No. 5,646,327 (Burns et al), the disclosures of which are all incorporated herein by reference. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the structure I:

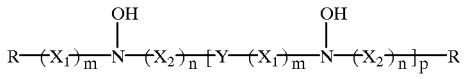

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is $—CR_2(OH)CHR_1—$ and $X_2$ is $—CHR_1CR_2(OH)—$ wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Many of the noted antioxidants (organic or inorganic) are either commercially available or prepared using starting materials and procedures described in the references noted above in describing hydroxylamines.

Buffering agents are generally present in the color developing compositions of this invention to provide or maintain desired alkaline pH of from about 7 to about 13, and preferably from about 8 to about 12. These buffering agents must be soluble in the organic solvent described herein and have a pKa of from about 9 to about 13. Such useful buffering agents include, but are not limited to, carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

An essential component of the color developing concentrates of this invention is a photographically inactive, water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and triethylene glycol), polyhydroxyamines (including polyalkanolamines), and alcohols (such as ethanol and benzyl alcohol). Glycols are preferred with ethylene glycol, diethylene glycol and triethylene glycol being most preferred. Of the alcohols, ethanol and benzyl alcohol are most preferred. The most preferred organic solvent is diethylene glycol.

The amounts of water and organic solvent in the concentrate are carefully controlled to achieve all of the desired results and to insure a single phase homogeneous concentrate. If there is too much water, phase separation may occur. If there is too much organic solvent, the buffering agent and other salts will precipitate.

The color developing concentrates of this invention can also include one or more of a variety of other addenda that are commonly used in color developing compositions, including alkali metal halides (such as potassium chloride, potassium bromide, sodium bromide and sodium iodide), metal sequestering compositions (such as polycarboxylic or aminopolycarboxylic acids or polyphosphonates with or without lithium, magnesium or other small cations), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure*, noted above]. The amounts of such additives are well known in the art also. Representative color developing concentrates of this invention are described below in Example 1.

The following TABLE I shows the general and preferred amounts of essential components of the color developing concentrates of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath.

TABLE I

| COMPONENT | CONCENTRATE CONCENTRATIONS |
|---|---|
| Color developing agent | 0.06–0.3 mol/l (0.1–0.2 mol/l) |
| Antioxidant | 0.05–1 mol/l (0.1–0.6 mol/l) |
| Water to organic solvent (weight ratio) | 25:75–50:50 (30:70–40:60) |
| Buffering agent | 0.1–2 mol/l (0.15–1.8 mol/l) |

The color developing concentrates of this invention have utility to provide color development in an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure*, noted above). In particular, the invention can be used to process color photographic papers of all types of emulsions including so-called "high chloride" and "low chloride" type emulsions, and so-called tabular grain emulsions as well. The color developer solution can also be used in processing of color reversal and color negative films.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.

Color development of an imagewise exposed photographic silver halide element is carried out by contacting the element with a color developing composition prepared according to this invention under suitable time and temperature conditions, in suitable processing equipment, to produce the desired developed image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C41 processing of color negative films, Process RA-4 for processing color papers and Process E-6 for processing color reversal films (see for example, *Research Disclosure*, noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure*, noted above. Included within such teachings in the art is the use of various classes of cyan, yellow and magenta color couplers that can be used with the present invention (including pyrazolone and pyrazolotriazole type magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The color developing concentrate of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

Color development is generally followed by a bleaching or bleach/fixing step using a suitable silver bleaching agent. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure*, noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al).

The processing time and temperature used for each processing step of the present invention are generally those conventionally used in the art. For example, color development is generally carried out at a temperature of from about 20 to about 60° C. The overall color development time can be up to 40 minutes, and preferably from about 75 to about 450 seconds. The shorter overall color development times are desired for processing color photographic papers.

The color developing concentrate of this invention can be formulated into a working strength solution or replenisher by suitable dilution of up to 12 times. Generally, the dilution rate is from about 4 to about 10 times, using water as a common diluent. Dilution can occur during or prior to processing.

In one embodiment of this invention, the color developing concentrate is one chemical formulation in a photographic processing chemical kit that can include one or more other photographic processing compositions (dry or liquid) including, but not limited to, a photographic bleaching composition, a photographic bleach/fixing composition, a photographic fixing composition, and a photographic stabilizing or rinsing composition. Such additional compositions can be formulated in concentrated or working strength solutions, or provided in dry form (for example, as a powder or tablet). Other processing compositions that can be included in such kits for either black and white or color photographic processing are reversal compositions, conditioning compositions, prebleach compositions, acidic stop compositions, and others readily apparent to one skilled in the photographic art. The processing kits can also include various processing equipment, metering devices, processing instructions, silver recovery devices and other conventional materials as would be readily apparent to one skilled in the art.

The following examples are provided to illustrate the practice of this invention and not to limit it in any way. Unless otherwise indicated, percentages are by weight.

EXAMPLE 1

Color Paper Color Developing Concentrate

A color developing concentrate of this invention (about 100 ml) was formulated in the following manner:

A solution of sodium hydroxide (50% solution, 4 g) was added to a solution of $^4$-(N-ethyl-N-2-methanesulfonylaminoethyl)-2-methylphenylenediamine sesquisulfate (CD-3, 6.8 g) and diethylhydroxylamine (5.4 g) in water (6 g). Because diethylhydroxylamine is an organic liquid, two phases resulted. With stirring, diethylene glycol (50 g) was then added, and a precipitate of sodium sulfate was observed. This precipitate was filtered out of the solution, washed with 20 g of diethylene glycol and discarded.

The following components were then added to the single-phase formulation:

TABLE II

| | |
|---|---|
| Triethanolamine (85% solution) | 3 g |
| Substituted triazinylstilbene optical brightener | 1.17 g |
| Magnesium chloride (6 $H_2O$) | 0.16 g |
| Polystyrene sulfonate (VERSA TL-73, 30%, from National Starch) | 1.7 g |
| 1-Hydroxyethylidene-1,1-diphosphonic acid (60% w/w solution, DEQUEST 2010) | 0.86 g |
| or | or |
| DEQUEST 2066 diethylenetriaminepenta-phosphonic acid, sodium salt (Solutia Co.) | 4 ml |
| Potassium chloride | 1.1 g |
| Potassium bromide | 0.03 g |
| Potassium carbonate (47% solution) | 52.6 g |
| Lithium chloride | 1.55 g |

After addition of these components, the mixture was stirred until a homogeneous solution was obtained, filtered to remove a slight haze, and packaged as a color developing concentrate. This concentrate was essentially free of all sulfate ions.

EXAMPLES 2 and 3

Alternative Color Paper Color Developing Concentrates

Example 1 was repeated except that either ethylene glycol (Example 2) or dipropylene glycol (Example 3) was used in place of diethylene glycol. In both instances, a homogeneous, single part color developing concentrate was achieved.

EXAMPLE 4

Preferred Color Paper Color Developing Concentrate

A concentrate was prepared like that shown in Example 1 except diethylhydroxylamine was replaced with N,N'-bis(2,3-dihydroxypropyl)hydroxylamine (5.4 g of 50% solution). The resulting concentrate (about 100 ml) was homogeneous and free of haze and sulfate ions.

EXAMPLE 5

Preparation of Working Strength Color Developing Composition and Processing of Color Paper A color developing composition useful for photoprocessing was prepared by diluting the concentrate described in Example 1 ten times with water.

This composition was then used for color development in processing imagewise exposed samples of commercially available KODAK EKTACOLOR EDGE 5 Color Papers using the following processing protocol and conditions to obtain acceptable color images:

| | | |
|---|---|---|
| Color Development | 38° C. | 45 seconds |
| Bleach/fixing | 35° C. | 45 seconds |
| Washing (water) | 35° C. | 90 seconds |

Bleach/fixing was carried out using commercially available EKTACOLOR RA Bleach Fix NR.

EXAMPLE 6

Color Negative Film Color Developing Concentrate

A color developing concentrate useful for processing color negative film was prepared as follows:

A solution of sodium hydroxide (50% solution, 2.5 g) was added to a solution of KODAK Color Developing Agent CD-4 (4.5 g) and N,N'-bis(2,3-dihydroxypropyl) hydroxylamine (1.0 g, 50% solution) in water (3 g). Two phases resulted. With stirring, diethylene glycol (50 g) was then added, and a precipitate of sodium sulfate was observed. This precipitate was filtered out of the solution, washed with 20 g of diethylene glycol and discarded.

The following components were then added to the single-phase formulation:

TABLE III

| | |
|---|---|
| Sodium metabisulfite | 3.25 g |
| Diethylenetriaminepentaacetic acid, pentasodium salt (40% solution) | 8.25 g |
| Potassium iodide | 0.01 g |
| Potassium bromide | 1.13 g |
| Potassium carbonate (47% solution) | 69.5 g |

After addition of these components, the mixture was stirred until a homogeneous solution was obtained, filtered to remove a slight haze, and packaged as a color developing concentrate. This concentrate was essentially free of all sulfate ions.

The invention has been described in detail with particular reference to preferred embodiments thereof, but it will be understood that variations and modifications can be effected within the spirit and scope of the invention.

We claim:

1. A homogeneous, single-part color developing concentrate having a pH of from about 7 to about 13 and comprising:

a) at least 0.06 mol/l of a color developing agent in free base form, b) at least 0.05 mol/l of an antioxidant for said color developing agent, c) water, d) a water-miscible or water-soluble hydroxy-substituted, straight-chain organic solvent that has a molecular weight of from about 50 to about 200, and is present in said concentrate at a concentration such that the weight ratio of water to said solvent is from about 15:85 to about 50:50, and e) a buffering agent that is soluble in said organic solvent.

2. The color developing concentrate of claim 1 having a pH of from about 8 to about 12.

3. The color developing concentrate of claim 1 wherein said color developing agent is present in an amount of from about 0.06 to about 0.3 mol/l, said antioxidant is present in an amount of from about 0.05 to about 1 mol/l, and the weight ratio of water to said organic solvent is from about 30:70 to about 40:60.

4. The color developing concentrate of claim 1 wherein said antioxidant is a hydroxylamine derivative having a solubilizing group.

5. The color developing concentrate of claim 4 wherein said antioxidant is represented by the structure I:

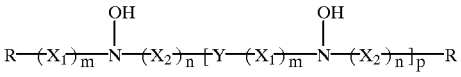

wherein R is hydrogen, an alkyl group, a hydroxyalkyl group, a cycloalkyl group or an aryl group, $R_1$ and $R_2$ are independently hydrogen, hydroxy, an alkyl group, or a hydroxyalkyl group, or $R_1$ and $R_2$ together represent the carbon atoms necessary to complete a 5- to 8-membered carbocyclic ring structure, $X_1$ is —$CR_2(OH)CHR_1$—, $X_2$ is —$CHR_1CR_2(OH)$—, and m, n and p are independently 0 or 1.

6. The color developing concentrate of claim 1 wherein said organic solvent is an aliphatic compound having a molecular weight of from about 100 to about 200, and has from 2 to 10 carbon atoms.

7. The color developing concentrate of claim 6 wherein said solvent is an alcohol or glycol.

8. The color developing concentrate of claim 7 wherein said organic solvent is ethylene glycol, diethylene glycol, triethylene glycol, ethanol or benzyl alcohol.

9. The color developing concentrate of claim 8 wherein said solvent is diethylene glycol.

10. The color developing concentrate of claim 1 wherein said buffering agent is a carbonate.

11. The color developing concentrate of claim 1 further comprising one or more of the following components:

e) chloride ions, f) bromide ions, g) a metal ion sequestering composition, h) a triazinylstilbene optical brightening agent, i) a polyalkanolamine, or j) a fragrance.

12. A photographic processing chemical kit comprising:

a) the single-part color developing concentrate of claim 1, and b) one or more of the following compositions:
a photographic bleaching composition,
a photographic bleach/fixing composition,
a photographic fixing composition, or
a photographic stabilizing or final rinsing composition.

13. A method for providing an image in a photographic silver halide element comprising contacting a photographic silver halide material with, upon dilution at least four times, the single-part color developing concentrate of claim 1.

14. A method of photographic processing comprising the steps of:

A) color developing an imagewise exposed photographic color silver halide element with, upon dilution at least four times, the single-part color developing concentrate of claim 1, and B) desilvering said color developed photographic color silver halide element.

15. The method of claim 14 wherein said photographic color silver halide element is a color negative silver halide film.

16. The method of claim 14 wherein said photographic color silver halide element is a color paper.

17. A method of preparing a homogeneous, ready to use, sulfate-free, single-part color developing composition comprising the steps of:

A) mixing in water, a color developing agent present as a sulfate salt, an antioxidant for said color developing agent, alkali metal ions in at least stoichiometric proportion to said sulfate salt, and a water-miscible or water-soluble, straight-chain organic solvent having a molecular weight of from about 50 to about 200, and present at a concentration such that the weight ratio of water to said solvent is from about 15:85 to about 50:50, to form an alkali metal sulfate in the solution, and B) removing said alkali metal sulfate from said solution to prepare the concentrate of claim 1.

18. The method of claim 17 wherein said alkali metal ions are provided as part of an alkali metal hydroxide.

19. The method of claim 17 further comprising the step of:

C) adding to said solution one or more of the following components:
a buffering agent,
chloride ions,
bromide ions,
a metal ion sequestering composition,
a triazinylstilbene optical brightening agent,
a alkanolamine, or
a fragrance.

20. The method of claim 17 wherein said antioxidant is represented by the structure I:

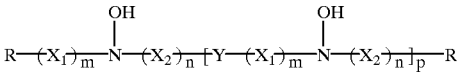

wherein R is hydrogen, an alkyl group, a hydroxyalkyl group, a cycloalkyl group or an aryl group, $R_1$ and $R_2$ are independently hydrogen, hydroxy, an alkyl group, or a hydroxyalkyl group, or $R_1$ and $R_2$ together represent the carbon atoms necessary to complete a 5- to 8-membered carbocyclic ring structure, $X_1$ is $—CR_2(OH)CHR_1—$, $X_2$ is $—CHR_1CH(OH)—$, and m, n and p are independently 0 or 1.

21. A homogeneous, single-part color developing concentrate that is essentially free of sulfate ion, having a pH of from about 7 to about 13 and comprising:

a) at least 0.06 mol/l of a color developing agent in free base form, b) at least 0.05 mol/l of an antioxidant for said color developing agent, c) water, d) a water-miscible or water-soluble hydroxy-substituted, straight-chain organic solvent that has a molecular weight of from about 50 to about 200, and is present in said concentrate at a concentration such that the weight ratio of water to said solvent is from about 15:85 to about 50:50, and e) a buffering agent that is soluble in said organic solvent.

* * * * *